US005152332A

United States Patent [19]

Siener

[11] Patent Number: 5,152,332

[45] Date of Patent: Oct. 6, 1992

[54] MOVABLE WALL SYSTEM

[75] Inventor: David Siener, Indianapolis, Ind.

[73] Assignee: Modernfold, Inc., New Castle, Ind.

[21] Appl. No.: 661,467

[22] Filed: Feb. 26, 1991

[51] Int. Cl.[5] ..... E05F 15/00

[52] U.S. Cl. ..... 160/188; 160/206; 160/199

[58] Field of Search ..... 160/188, 199, 209, 206, 160/196.1, 201

[56] References Cited

U.S. PATENT DOCUMENTS 2,929,445 3/1960 Haws ..... 160/199 X
3,374,821 3/1968 White ..... 160/206 X
3,414,040 12/1968 Harris ..... 160/188
3,448,786 6/1969 Edgerton, Jr. ..... 160/199
4,106,544 8/1978 Dixon et al. ..... 160/199

*Primary Examiner*—Blair M. Johnson
*Attorney, Agent, or Firm*—Baker & Daniels

[57] ABSTRACT

A movable wall system used to divide a large room into small rooms has a train of wall panels connected by hinges. The system includes a mechanism for automatically flattening the panels when moving them into their fully extended position by applying a momentary backward force to the panels as the panels approach the extended position. The system also includes a mechanism for breaking the panels to permit easy retraction and stacking of the panels. A rotatable cam positioned on the overhead track of the wall system forces a hinge of two connected panels outward so that the panels will stack when a reversing force is applied to the panels.

19 Claims, 4 Drawing Sheets

MOVABLE WALL SYSTEM

FIELD OF THE INVENTION

This invention relates to movable wall systems used to divide large rooms into smaller rooms.

BACKGROUND OF THE INVENTION

A movable wall system comprised of a plurality of continuously hinged panels is traditionally extended or retracted (stacked) by either manual means or with the assistance of an overhead electrical chain drive system. Electric systems may be desirable for a multitude of reasons, such as the weight of the panels (and the force required to move the wall) being prohibitive for a typical individual to move manually, or simply for convenience. Aptly powered electrical systems are successful in moving the wall, but, as described below, are often inefficient when "flattening" the wall once it is nearly fully extended and when "breaking" the wall to begin retracting the wall from its fully extended position. These inefficiencies are translated into increased costs in manufacturing and in maintaining the electrically driven systems. Alternatives need to be provided which are both efficient and cost effective.

When extending a movable wall, it is important that all of the wall panels be completely coplanar or "flattened" for a variety of reasons. Aesthetically, the wall will be more pleasing if it is entirely flat thereby appearing more like permanent walls. If the wall is dividing areas in which limited sound transmission between the rooms is of concern, there must be no gaps between the panels of the movable wall, nor should there be gaps at either end of the movable wall. Any gaps significantly reduce the acoustic quality of the wall. Also, it is very important that the wall be fully extended, rigid, and locked into position, so that the wall does not begin to retract if a force is inadvertently applied to move the wall toward the stacked position.

Some electrically driven systems incorporate large motors, that provide much more horsepower than actually required to move the wall, to solve the flatness problem. These systems use so much force to extend the wall that the panels "snap" into place from inertial force. This is an expensive solution, not only in terms of manufacturing costs, but also in the maintenance of the systems since the electric motor will experience undue loads while attempting to flatten the wall and, hence, its life cycle may be shortened.

To assist an electric system in solving the flatness problem, some systems connect adjacent panels with cables and/or springs to straighten the wall when near the fully extended position. These systems are costly to manufacture, are difficult to service as they require constant adjustment to function properly, and have a tendency to destroy the trim on the panel.

When retracting (stacking) the continuously hinged movable wall, several methods are used to begin the retraction process. The retraction process will begin very simply if a deflection is made in the joint between adjacent panels that are closest to the stack jamb. This is called "breaking" the wall. In some systems, this deflection must be made manually, i.e. by a person pushing the abutting edges of the two adjacent panels to cause the panels to pivot. Another method is to use a "retraction bar." This bar is connected via a pivot point to the top of the panel closest to the stack jamb and is fixed to the ceiling. As the drive motor urges the panels toward the retracted position, the retraction bar translates the backward force to a sideward force, causing the trailing panel to break. This type of breaking assembly still requires a large motor to create a break in the wall and imposes undue stress on the motor, thus reducing motor life span. In addition, a retraction bar is inappropriate for a movable wall system with stringent sound transmission requirements as the bar protrudes through the upper trim of the first panel. Moreover, a retraction bar is aesthetically undesirable as it is visible. Finally, the retraction bar is a control system independent from the electric drive, so the functions of each are not coordinated.

OBJECTS OF THE INVENTION

Accordingly, it is an object of the invention to provide a movable wall panel system which does not require the use of a relatively large motor to either flatten or break the wall panels.

It is another object of the invention to provide a movable wall panel system that does not require cable and/or spring subsystems to connect adjacent panels to assist in completing the flattening process.

It is another object of the invention to provide a movable wall panel system in which the wall is automatically flattened.

It is another object of the invention to provide a movable wall panels system that does not require the use of a retraction bar to perform the break the walls from the fully extended position.

It is another object of the invention to provide a movable wall panel system in which breaking the wall from a fully extended position is accomplished by automatic means.

It is another object of the invention to provide a movable wall panel system in which mechanisms provided for breaking the wall from a fully extended position do not adversely affect the acoustic quality of the wall.

It is another object of the invention to provide a movable wall panel system in which flattening and breaking are accomplished through the use of an integrated system which requires only one power source.

SUMMARY OF THE INVENTION

A movable wall panel system comprises at least two connected movable wall panels, each panel having opposing sides, the wall panels being movable along a predetermined path having a midline, the panels being movable between an extended position in which the opposing sides of the panels are substantially coplanar, and a non-extended position in which the planes defined by the opposing sides of the panels intersect. An electrically powered actuator is disposed adjacent the path traversed by the wall panels, the actuator having a contact member capable of engaging at least one of the wall panels to apply a force against the wall panel to thereby move the wall panels from the extended position to the non-extended position. Each connected pair of adjacent wall panels can also be characterized in that one panel may pivot along a vertical pivot axis with respect to its connected adjacent wall panel, and the panels being movable between a fully extended position in which the planes defined by the respective opposing surfaces of the wall panels are coplanar, a partially extended position in which the planes defined by the respective opposing surfaces of the wall panels are not coplanar and in which each vertical pivot axis is on the same side of the midline of the predetermined path as when the panels are in the fully extended position, and a non-extended position in which the planes defined by the opposing surfaces of the wall panels are not coplanar and in which not all vertical pivot axes are on the same side of the midline of the predetermined path as when the panels are in the fully extended position. A means is provided for applying a forward force to the panels to thereby move the panels from the non-extended position toward the partially extended position. A motor means is provided for automatically applying a force in the reverse direction when the panels move from the non-extended position to the partially extended position, to thereby move the panels to the fully extended position.

DETAILED DESCRIPTION

Figures 1, 2, 3, 4:
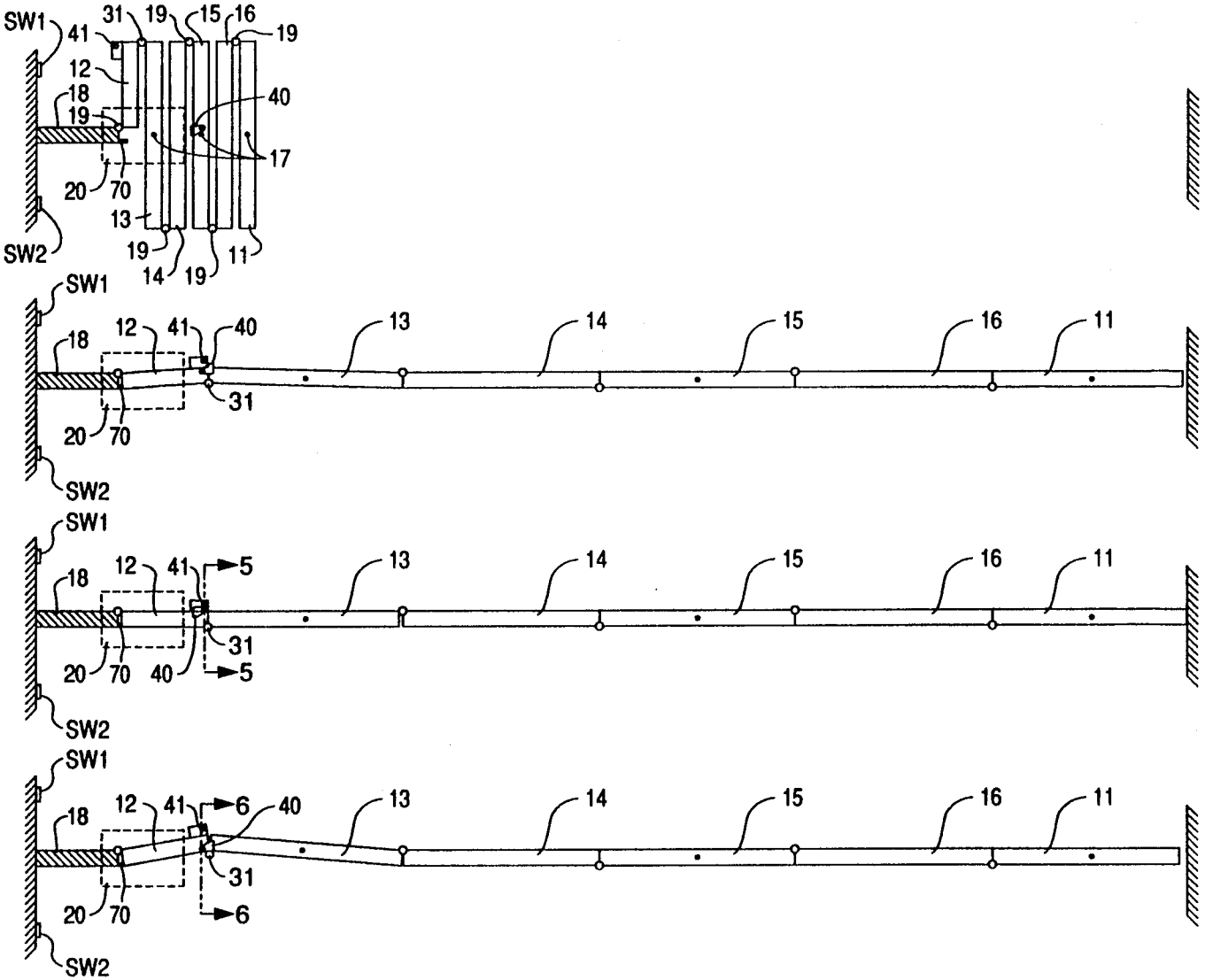
FIG. 1 shows an overhead diagrammatic view of a movable wall panel system in accordance with the present invention in which the wall panels are in a stacked position.
FIG. 2 shows an overhead diagrammatic view of a wall panel system in accordance with the present invention in which the wall panels are in a partially extended position.
FIG. 3 shows an overhead diagrammatic view of a movable wall panel system in accordance with the present invention in which the wall panels are in a fully extended position.
FIG. 4 shows an overhead diagrammatic view of the movable wall system of the present invention showing the wall panels in a non-extended position.
Figure 5:
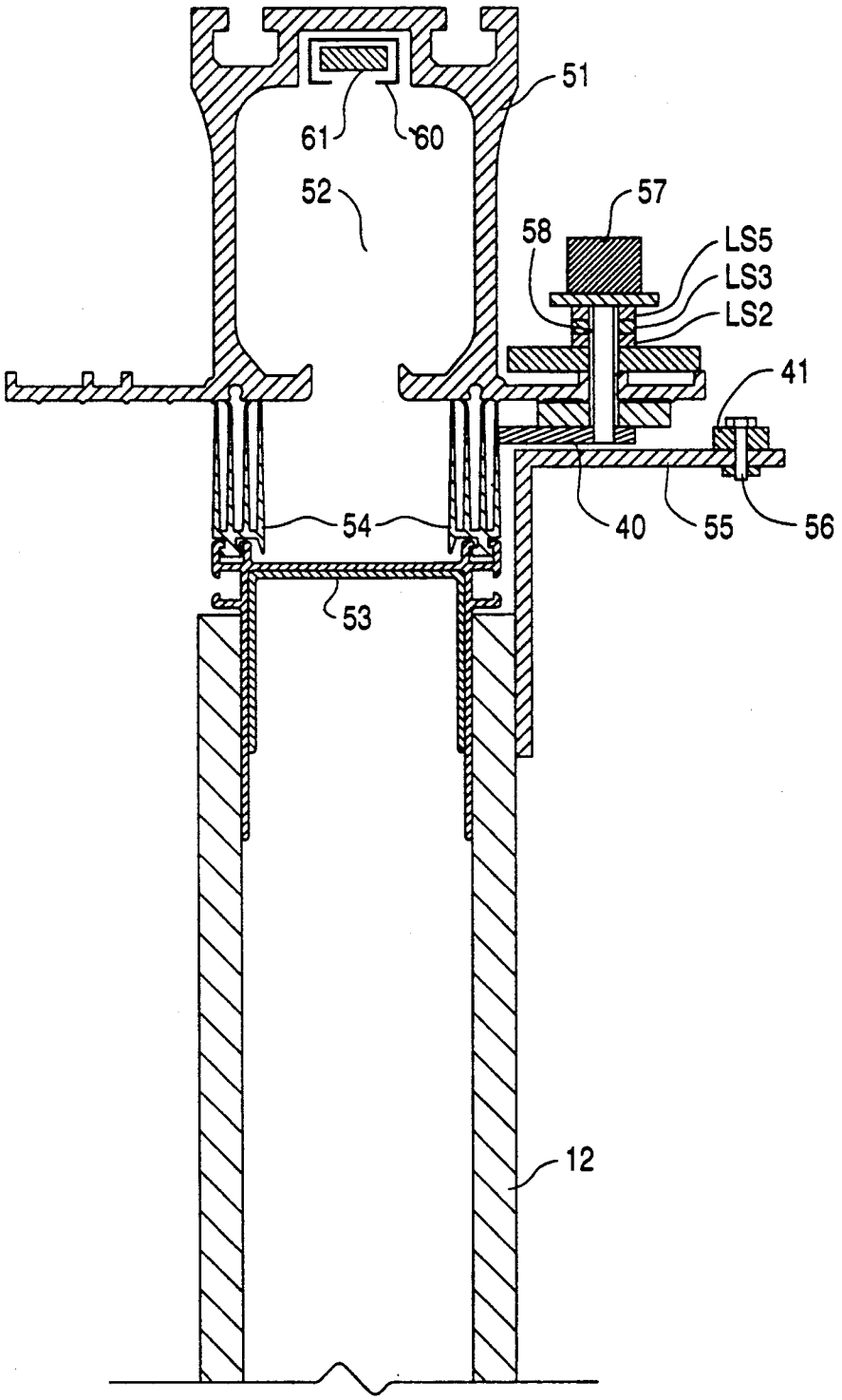
FIG. 5 shows a vertical section view of the movable wall panel system of the present invention showing an electrically powered actuator and the wall panels a fully extended position.
Figure 6:
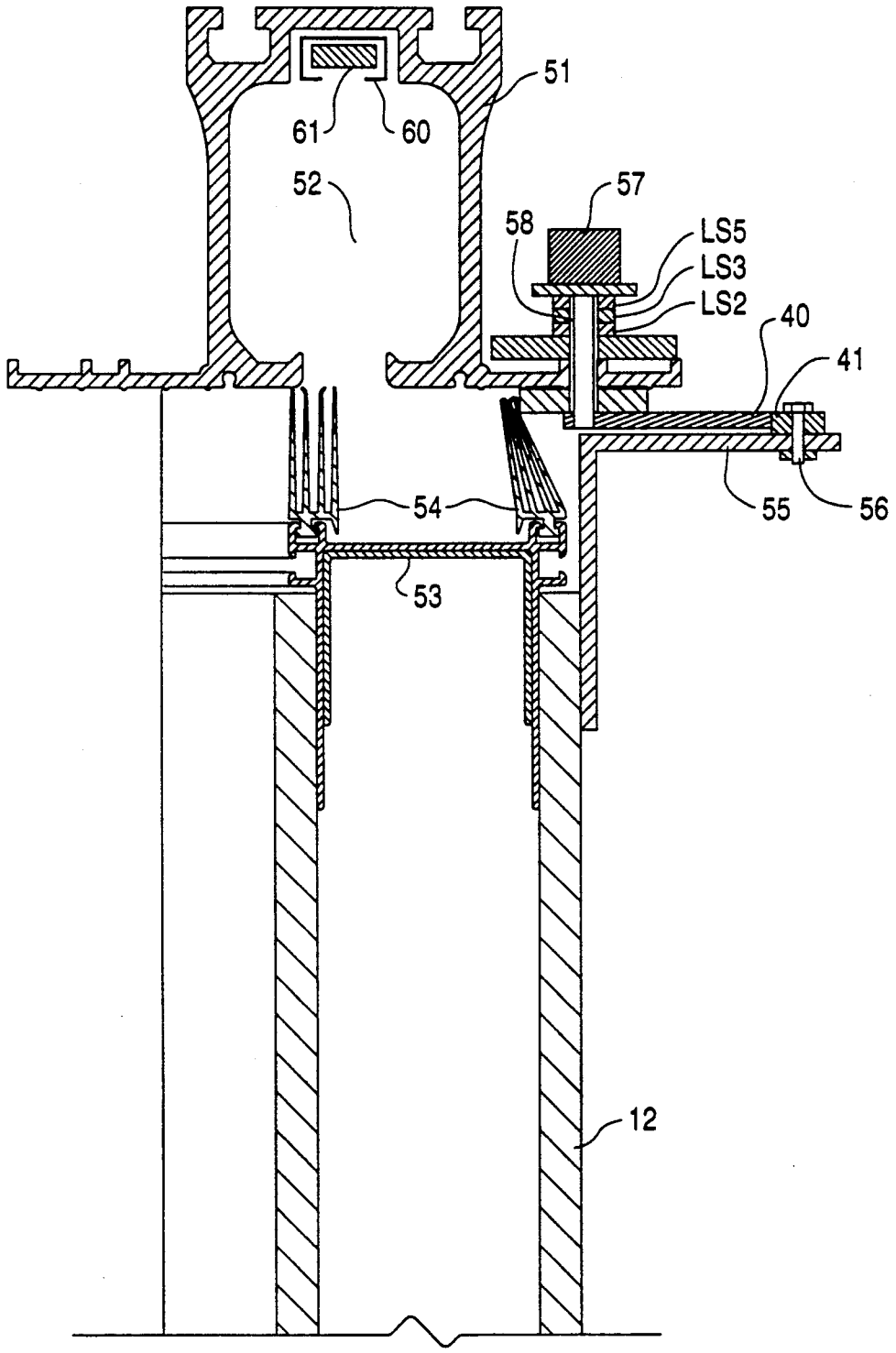
FIG. 6 shows a vertical section of the movable wall panel system in accordance with the present invention showing the electrically powered actuator having moved the panels into the non-extended position.

Referring now to the FIG. 1, there is shown an overhead diagrammatic view of a wall panel system in accordance with the present invention with the panels located in the "stacked" face-to-face orientation. The movable panel system consists of leading panel 11, trailing panel 12, and intermediate panels 13, 14, 15 and 16. Leading panel 11 and each alternate panel thereafter is provided with upwardly projecting trolley 17 which fits into an overhead track (not shown) which defines a predetermined path extending across the room. The centerline of that predetermined path is the midline. Trailing panel 12 is hingedly connected to wall jamb 18 by hinge 19. Likewise, all other adjacent panels are connected by hinges 19, which thereby define a vertical pivot axis with respect to adjacent wall panels. The wall panel system of the present invention is preferably movable by an electric drive motor and associated hardware 20 which is positioned above the overhead track. Motor 20 drives chain 61 positioned in track channel 60 (as shown in FIGS. 5 and 6) which is connected to trolley 17 of leading panel 11. Motor 20 may be driven in either direction to extend the wall panels or to retract the wall panels. Moreover, in the preferred embodiment, drive motor 20 is of the capacitance inductance type to thereby provide additional power and torque when the motor is first actuated.

In order to extend the wall panels, electrical switches SW1 and SW2 (FIG. 7) are simultaneously actuated. In the preferred embodiment, switches SW1 and SW2 are positioned on alternate sides of the overhead track as shown in FIGS. 1, 2, 3 and 4, and therefore require two separate persons to independently actuate the switches. This provides a safety mechanism to prevent inadvertent injury to persons positioned near the wall panels.

As leading panel 11 is moved toward the opposite end of the room to the partially extended position shown in FIG. 2, the panels at the front of the train, namely panels 11, 16, 15 and 14, will tend to move into a "flattened" position. It will be appreciated that each wall panel is comprised of two opposing sides and that when adjacent panels are completely flattened, the opposing sides of adjacent panels will be substantially coplanar. However, the panels at the opposite end of the train will not usually automatically move into a position in which their opposing sides are coplanar with the panels toward the leading end of the train. As shown in FIG. 2, panels 12 and 13 are disposed in a slightly angular relationship. However, when the panels are in the partially extended position as shown in FIG. 2, each hinge is on the same side of the midline of the track as when the panels are in the fully extended position shown in FIG. 3. It will be appreciated by those of skill in the art that when hinge 31 is on the same side of the midline as when all panels are in the fully extended position, and a reversing force is applied from leading panel 11 toward jamb 18, that all panels will be moved into the fully extended or "flattened" position shown in FIG. 3.

It will further be appreciated that the reversing action of motor 20 should be actuated only after wall panels 12 and 13 have moved from the non-extended position to the partially extended position. As is evident by comparing FIG. 4 to FIG. 2, when wall panel 12 moves into the partially extended position, the gap between it and jamb 18 is reduced in size and accordingly, panel 12 depresses limit switch 70. As described below, this causes the forward motion of drive motor 20 to cease and causes drive motor 20 to momentarily move in the reverse direction.

It will further be appreciated that when a reverse force is applied from leading panel 11, and hinge 31 is on the opposite side of the track midline as shown in FIG. 4, that the reverse force will tend to push hinge 31 upward so that the panels begin to retract and move into the face-to-face stacked relationship shown in FIG. 1.

Accordingly, it may be appreciated that there may be defined three distinct types of positions in which the panels may be positioned, namely, a fully extended position in which the planes defined by the respective opposing surfaces of the wall panels are coplanar as shown in FIG. 3, a partially extended position as shown in FIG. 2 in which the planes defined by the respective opposing surfaces of the wall panels are not coplanar (i.e., the planes defined by panels 12 and 13 in FIG. 2) but in which the vertical pivot axes of each hinge is on the same side of the midline of the track as when the panels are in the fully extended position, and, a non-extended position as shown in FIGS. 1 and 4 in which the planes defined by the opposing surfaces of the wall panels are not coplanar and in which not all vertical pivot axes are on the same side of the midline of the track as when the panels are in the fully extended position.

It will be further appreciated by those of skill in the art that once the panels are in the fully extended position as shown in FIG. 3, that the panels must be "broken" before they may be moved to their retracted position shown in FIG. 1. Obviously, when the wall panels are flattened and a reverse force is applied to the leading panel 11, the force will only jam the edges of the panels together unless one of the panels is able to pivot. Accordingly, it is an important objective of the present invention to provide a system in which two adjacent panels may be "broken," i.e., the vertical pivot axis moved so that it is on the opposite side of the midline of the track.

In the preferred embodiment of the present invention, adjacent panels 12 and 13 may be broken by a contact member such as rotatable cam 40. Cam 40 is attached to the overhead track and is positioned to engage at least one of the wall panels to apply a force against the wall panel to thereby move the wall panels from the extended position to the non-extended position. In particular, with reference to FIG. 4, it will be appreciated that cam 40 has been rotated 180° from the position shown in FIG. 3 and cam 40 has contacted the cam engaging surface of the wall panel 12, such as cam follower 41 during this process. Moreover, in the preferred embodiment, the cam is rotated prior to power being supplied to the overhead drive motor to begin retracting the panels.

The movement of the cam in order to break the panels may be further appreciated with reference to FIGS. 5 and 6. FIG. 5 shows overhead track 51 which includes interior chamber 52 capable of receiving a dolly or trolley (not shown) which downwardly extends and connects to frame 53 of wall panel 12. Overhead track 51 also includes chain housing 60 and chain 61. As described above, chain 61 is connected to the trolley attached to leading panel 11. Sweeps 54 are disposed intermediate the upper portion of wall panel 12 and track 51. Wall panel 12 further includes an upwardly and outwardly projecting flange 55 which supports cam follower 41 by bolt 56. Overhead track 51 also has mounted on one side thereof an electrically powered actuator comprised of timing motor 57 which drives downwardly extending shaft 58 and is attached to cam 40. Also mounted on shaft 58 are limit switches LS5, LS3 and LS2 which are described in further detail below.

It will be appreciated that wall panel 12 as shown in FIG. 5 is in the fully extended position and its midline is parallel with the midline of overhead track 51. When timing motor 57 is actuated to turn cam 40, cam 40 engages cam follower 41 to move wall panel 12 to the side and to the non-extended position shown in FIG. 6.

Figure 7:
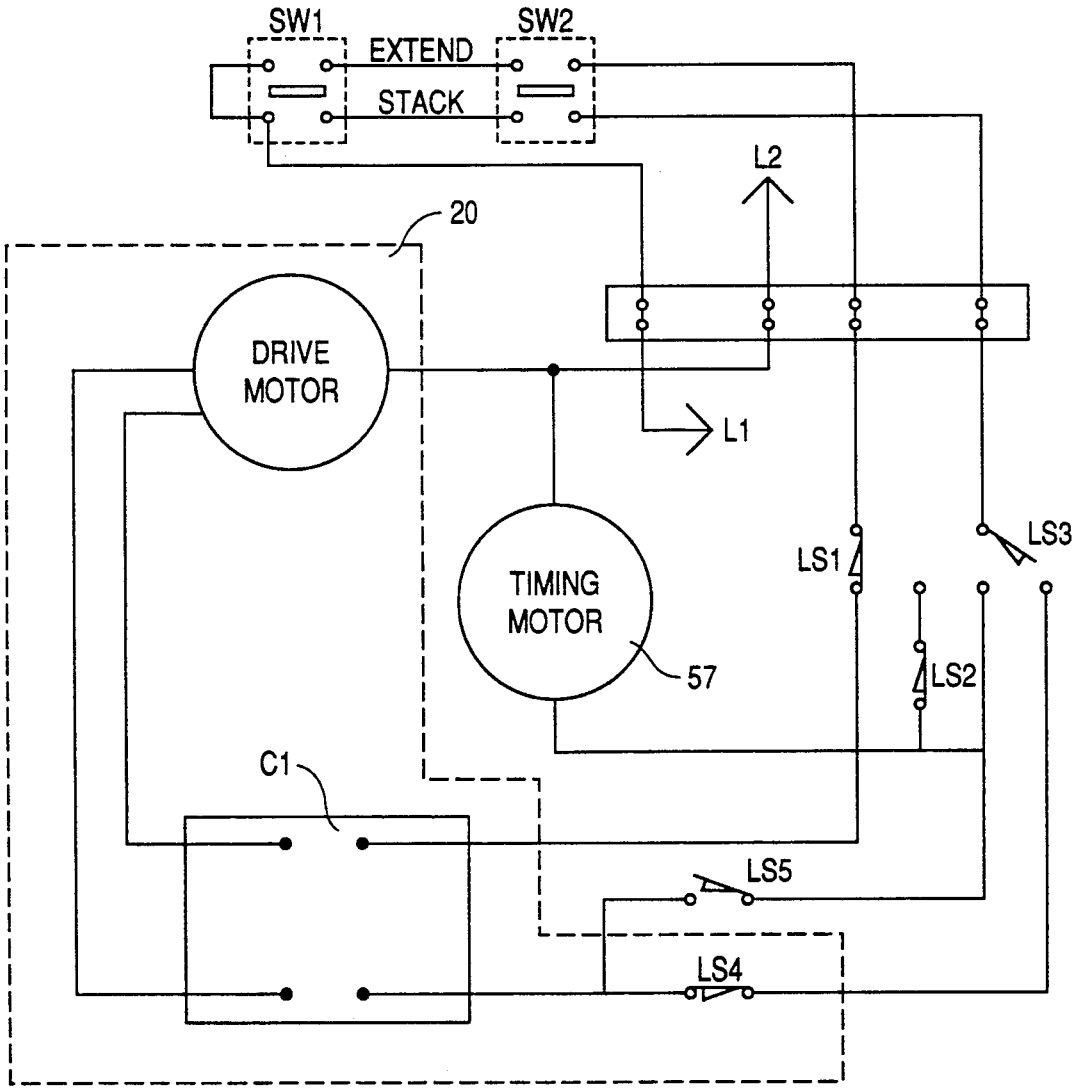
FIG. 7 shows a schematic of the electronic circuit in accordance with the present invention showing the interconnection of the drive motor, the timing motor, switches and wall switches.

A suitable drive motor system 20 for use with the present invention is the Modernfold 1000 drive unit available from Overhead Door Co., Inc. of Shelbyville, Ind. This system comes preconfigured with an additional limit switch, LS4 (as shown in FIG. 7), located on a shaft of the drive motor which may be adjusted to trip after the drive motor shaft has rotated a predetermined number of rotations. Accordingly, this trip switch is used to turn off the drive motor when the panels are retracted to the fully retracted position shown in FIG. 1.

To stack the wall, i.e., to move the wall from the fully extended position to a stacked position, both key switches SW1 and SW2 are placed in the stacked position. Key switches on both sides of the wall must be placed in this position to ensure that individuals on both sides of the wall are aware of the intention to begin stacking the wall. Once key switches SW1 and SW2 are engaged, timing motor 57 is actuated. Limit switch LS3 becomes activated only after cam 40 rotates 180 degrees. At that point, the panels will be "broken" and in the non-extended position. Once limit switch LS3 is activated, timing motor 57 is stopped and drive motor 20 is actuated, driving the panel system toward the stacked position. Once close to being completely stacked, limit switch LS4, which is located on the shaft of drive motor 20, is actuated, which stops drive motor 20.

To extend the movable wall system from its stacked position to the fully extended position, drive motor 20 is actuated after both key switches SW1 and SW2 are placed in the extend position. Key switches on both sides of the wall must be placed in this position to ensure that individuals on both sides of the wall are aware of the intention to begin extending the wall. Drive motor 20 continues to run and the wall continues to move toward the fully extended position until limit switch LS1 is activated. Limit switch LS1 as shown in FIGS. 1, 2, 3, and 4 is connected to the door jamb 18 in such a manner that when in movable wall panels are in the stacked or non-extended positions (shown in FIGS. 1 and 4 respectively) LS1 is not depressed or activated. In the partially extended position shown in FIG. 2, LS1 is activated by panel 12. In the fully extended position shown in FIG. 3, LS1 is depressed. In the preferred embodiment, at the time that limit switch LS1 is activated, drive motor 20 is stopped and timing motor 57 begins its reset cycle. The reset cycle of timing motor 57 starts by rotating cam 40 180 degrees. During that rotation, limit switch LS5 is activated and drive motor 20 is actuated to run in the reverse direction momentarily to bring the panels through to the fully flattened position. Timing motor 57 then continues to rotate until limit switch LS2 is activated. Once limit switch LS2 is activated, the reset cycle of timing motor 57 is complete.

It will further be appreciated that many changes could be made to the above embodiment which would be within the spirit and scope of the present invention. For example, any other actuating means, such as a solenoid, may be used to break the panels instead of the disclosed cam. Alternatively, electronic timers could be used to actuate the drive motor and breaking actuator, instead of the rotary limit switches. It would also be within the spirit of the invention to employ a depressible limit switch position at the far end of the wall system in lieu of the limit switch located in the stack jamb.

I claim:

1. A movable wall panel system comprising: at least two connected movable wall panels, each panel having opposing sides, the wall panels being movable along a predetermined path, the panels being movable between an extended position in which the opposing sides of the panels are substantially coplanar, and a non-extended position in which the planes defined by the opposing sides of the panels intersect, an electrically powered actuator disposed adjacent the path traversed by the wall panels, the actuator having a contact member capable of engaging at least one of the wall panels to apply a force against one of the opposing sides of the wall panel to thereby move the wall panels from the extended position to the non-extended position.

2. The movable wall panel system of claim 1 wherein all panels in the system are continuously hinged together.

3. The movable wall panel system of claim 1 further comprising a drive motor for moving the panels along the predetermined path.

4. The movable wall panel system of claim 3 further comprising means for delaying powering of the drive motor based upon movement of the actuator.

5. The movable wall panel system of claim 3 further comprising means for delaying powering of the drive motor until the actuator has moved the panels to the non-extended position.

6. The movable wall panel system of claim 3 wherein the drive motor moves the panels in forward and a reverse direction, and further comprising means for automatically reversing the direction of movement of the wall panels to move the panels from the non-extended position to the extended position.

7. The movable wall panel system of claim 1 further comprising an overhead track from which the wall panels are suspended, and wherein the actuator is affixed to the overhead track.

8. The movable wall panel system of claim 1 wherein the actuator is positioned to strike a wall panel adjacent the edge connecting the panel to an adjacent wall panel.

9. The movable wall panel system of claim 1 wherein the actuator comprises a rotatable cam.

10. The movable wall panel system of claim 1 wherein the actuator comprises a solenoid.

11. The movable wall panel system of claim 1 wherein the wall panel engaged by the actuator includes an upwardly projecting cam engaging surface.

12. A movable wall panel system comprising:

a plurality of connected movable wall panels, each panel having opposing sides, the wall panels being movable along a predetermined path, the predetermined path having a midline, a stacked end and an opposite end, each connected pair of adjacent wall panels being characterized in that one panel may pivot along a vertical pivot axis with respect to its connected adjacent wall panel, the panels being movable between a fully extended position in which the planes defined by the respective opposing surfaces of the wall panels are coplanar, a partially extended position in which the planes defined by the respective opposing surfaces of the wall panels are not coplanar and in which each vertical pivot axis is on the same side of the midline of the predetermined path as when the panels are in the fully extended position, and a non-extended position in which the planes defined by the opposing surfaces of the wall panels are not coplanar and in which not all vertical pivot axes are on the same side of the midline of the predetermined path as when the panels are in the fully extended position, means for applying a forward force to the panels to thereby move the panels from the non-extended position toward the partially extended position, motor means for automatically applying a force in the reverse direction when the panels move from the non-extended position to the partially extended position, to thereby move the panels to the fully extended position, switch means operatively connected to the motor means such that actuation of the switch means reverses the motor means, and an electrically powered actuator disposed adjacent the path traversed by the wall panels, the actuator having a contact member capable of engaging at least one of the wall panels to apply a force against one of the opposing sides of the wall panel to thereby move the wall panels from the extended position to the non-extended position.

13. The movable wall panel system of claim 12 wherein the means for applying the forward force comprises the motor means.

14. The movable wall panel system of claim 12 wherein the wall panels are connected by hinges.

15. The movable wall panel system of claim 14 wherein the hinges comprise the vertical axes about which connected adjacent wall panels pivot.

16. The movable wall panel system of claim 12 wherein the switch means is actuable by a movable portion of the movable wall panel system to thereby actuate the motor means to apply the force in the reverse direction.

17. The movable wall panel system of claim 16 further comprising a jamb to which one of the panels is connected, the panel being movable between an abutting position in which it abuts the jamb and a non-abutting position in which it does not abut the jamb, the switch means being positioned so that it is actuated when the panel moves from the non-abutting position toward the abutting position.

18. The movable wall panel system of claim 12 wherein all panels in the system are continuously hinged together.

19. The movable wall panel system of claim 12 wherein the motor means and the switch means are disposed at the stacked end of the predetermined path.

* * * * *